US010060043B2

(12) United States Patent
Lifchits et al.

(10) Patent No.: US 10,060,043 B2
(45) Date of Patent: Aug. 28, 2018

(54) FORMING AN ARTICLE MADE OF METAL MATRIX COMPOSITE

(71) Applicant: Raytheon Canada Limited, Ottawa (CA)

(72) Inventors: Alexandre Lifchits, Wyevale (CA); Richard Hentzelt, Penetang (CA)

(73) Assignee: Raytheon Canada Limited (CA)

( * ) Notice: Subject to any disclaimer, the term of this patent is extended or adjusted under 35 U.S.C. 154(b) by 342 days.

(21) Appl. No.: 14/801,662

(22) Filed: Jul. 16, 2015

(65) Prior Publication Data

US 2017/0016135 A1 Jan. 19, 2017

(51) Int. Cl.

| | |
|---|---|
| ***C25D 11/24*** | (2006.01) |
| ***C25D 11/18*** | (2006.01) |
| ***C25D 11/04*** | (2006.01) |
| ***C25D 11/26*** | (2006.01) |
| ***C25D 11/30*** | (2006.01) |
| ***C25D 11/34*** | (2006.01) |
| ***C25D 11/00*** | (2006.01) |

(52) U.S. Cl.

CPC ..... *C25D 11/18* (2013.01); *C25D 11/005* (2013.01); *C25D 11/04* (2013.01); *C25D 11/24* (2013.01); *C25D 11/26* (2013.01); *C25D 11/30* (2013.01); *C25D 11/34* (2013.01)

(58) Field of Classification Search

None

See application file for complete search history.

(56) References Cited

U.S. PATENT DOCUMENTS

| | | | | |
|---|---|---|---|---|
| 3,141,746 | A | 7/1964 | De Lai | |
| 3,293,806 | A | 12/1966 | Holland | |
| 4,002,541 | A * | 1/1977 | Streander | B64C 1/38 148/285 |
| 4,875,907 | A | 10/1989 | Phaal et al. | |
| 2008/0026243 | A1 | 1/2008 | Pickard et al. | |
| 2008/0265218 | A1 * | 10/2008 | Lifchits | C25D 7/10 252/503 |
| 2012/0063071 | A1 | 3/2012 | Loutfy et al. | |
| 2017/0232579 | A1 * | 8/2017 | Loutfy | B24D 3/08 451/28 |

FOREIGN PATENT DOCUMENTS

JP H10-237693 A 9/1998

OTHER PUBLICATIONS

Lapping and Polishing Basics, South Bay Technologies Inc, website: https://web.archive.org/web/20121224185449/http://www.southbaytech.com/appnotes/54%20Lapping%20&%20Polishing%20Basics.pdf (Year: 2012).*

(Continued)

*Primary Examiner* — Brian W Cohen

(57) ABSTRACT

A method is disclosed for forming an article made of a metal matrix composite material having particles bonded to an anodizable matrix material. The method can include anodizing the anodizable matrix material to form an anodic layer on the anodizable matrix material. The method can also include machining at least a portion of the anodic layer.

10 Claims, 4 Drawing Sheets

(56) References Cited

OTHER PUBLICATIONS

Hirato, T. et al. "Electrolytic Codeposition of Silica Particles with Aluminum from AlCl3-Dimethylsulfone Electrolytes" Journal of The Electrochemical Society, 148, (4), C280-283, 2001. (Year: 2001).*

Ferreira et al., Anodization Mechanism on SiC Nanoparticle Reinforced Al Matrix Composites Produced by Power Metallurgy, Materials, Dec. 19, 2014, pp. 8151-8167, Switzerland.

Rizkia et al., Corrosion Resistance Enhancement of an Anodic Layer on an Aluminum Matrix Composite by Cerium Sealing, International Journal of Technology, Sep. 2015, pp. 1191-1197, Indonesia.

Anonymous, Lapping and Polishing Basics, http://www.southbaytech.com/appnotes/54%20Lapping%20&%20Polishing%20Basics.pdf, May 29, 2007, 7 pages, South Bay Technology Inc., San Clemente, CA.

European Extended Search Report dated Jun. 25, 2018; in EP application No. 16823942.4, 12 pages.

* cited by examiner

FORMING AN ARTICLE MADE OF METAL MATRIX COMPOSITE

BACKGROUND

Metal matrix composite materials have unique properties and are utilized in a wide variety of articles. Many metal matrix composites have particles bonded to a matrix material, which provides material properties that are advantageous in many applications. Some such metal matrix composites, which may include diamond particles having layer of beta-SiC bonded to aluminum matrix, form a material with an extremely low thermal expansion coefficient and very high thermal conductivity that is well suited for heat dissipation applications, such as manufacturing of heat sinks or heat spreaders. Other metal matrix composites include ceramic particles bonded in an aluminum matrix, which forms a unique material that is desirable for high performance brake pads. The particles of a metal matrix composite can also serve as abrasive particles for an abrasive cutting tool used to machine materials that are difficult to machine. Abrasive cutting tools are widely used to grind, cut, polish, etc. Such tools include an abrasive material, such as abrasive particles, held together within, or bonded to, a matrix material. For example, diamond or ceramic abrasive particles can be bonded to a metal matrix to provide an abrasive cutting tool that can machine a material that is difficult to machine (i.e., glass or composites). During the machining process, abrasive particles are gradually worn and/or lost from the exposed cutting surface. Such tool wear results in a loss of cutting ability that requires dressing of the tool to expose new abrasive particles from the interior of the tool.

Articles made of metal matrix composite materials, such as those discussed above, often require precise machining with tight tolerances. Typically, a manufacturing process for an article made of metal matrix composite includes forming a blank or workpiece by an acceptable method (e.g., hot isostatic pressing, squeeze casting, etc.). Because these composite materials are extremely hard to machine by conventional methods, the blank or workpiece is usually machined with a laser or a water jet. Unfortunately lasers and water jets are unable to maintain precise dimensions or tight tolerances.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
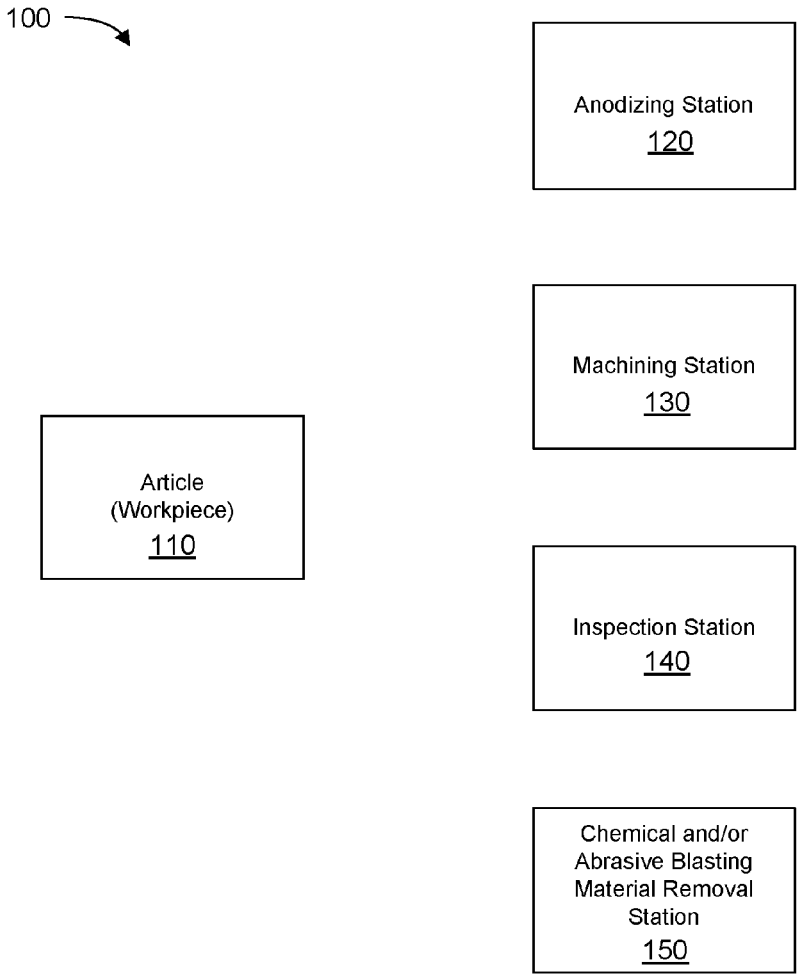
FIG. 1 is a schematic illustration of an article forming system, in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although it may be highly desirable to construct articles made from metal matrix composites having particles bonded to a matrix material, such as an anodizable material, these composite materials can be difficult to form or machine or prepare for use in accordance with design specifications and tolerances. This may preclude use these composite materials in applications where the composite materials are superior to the other alternatives. Thus, potential applications for articles with a metal matrix can increase by improving the ability to accurately machine and form such articles.

Accordingly, a method of forming an article made of particles bonded to an anodizable matrix material is disclosed that enables accurate machining of the article. In one aspect, tight tolerances on size and/or form of the article can be achieved to provide an article suitable for use in high precision applications. The method can include anodizing the anodizable matrix material to form an anodic layer on the anodizable matrix material. The method can further include machining at least a portion of the anodic layer.

In one aspect, an article forming system is disclosed. The system can include an article having particles bonded to an anodizable matrix material. The system can also include an anodizing station to form an anodic layer on the anodizable matrix material. The system can further include a machining station to machine at least a portion of the anodic layer.

In another aspect, an article in preparation is disclosed. The article can include an anodizable matrix material, particles bonded to the anodizable matrix material, and anodic layer on the anodizable matrix material formed by anodizing.

Figure 2:
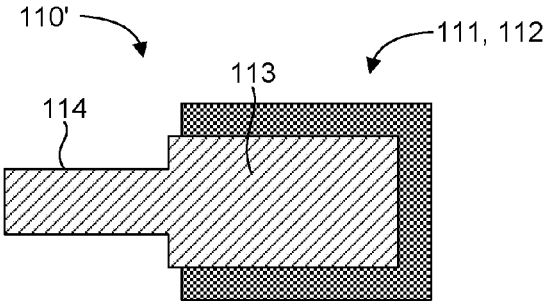
FIG. 2 is a cross-sectional view of an article, illustrated as an abrasive cutting tool, in accordance with an example of the present disclosure.

One embodiment of an article forming system 100 is illustrated in FIG. 1. The system 100 can comprise an article 110 that can serve as a workpiece for other aspects of the system 100 described hereinafter. The article 110 can be configured as any suitable type of article of manufacture that can be made in whole or in part from a metal matrix composite having particles bonded to an anodizable matrix material. A wide variety of different types of articles can therefore be formed in accordance with the principles disclosed herein. For example, some metal matrix composites have been found to have high thermal conductivity, which makes such materials desirable for constructing heat dissipating structures or substrates. One such material is a metal/diamond metal matrix composite made from diamond particles having thin layers of beta-SiC chemically bonded to the surfaces of the diamond particles, as disclosed in U.S. Patent Application Publication No. 2012/0063071, which is incorporated herein by reference. In another example, an abrasive cutting tool 110', as shown in cross-section in FIG. 2, can utilize a metal matrix composite with abrasive particles, such as abrasive grains or other such particles, held together within, or bonded to, a matrix. The particles and matrix are referred to generally in FIG. 2 as reference numbers 111 and 112, respectively. The abrasive cutting tool 110' can be of any suitable type or configuration known in the art. The abrasive cutting tool 110' is shown as a grinding wheel for purposes of illustration. Those skilled in the art will recognize that the present technology can be applied to a variety of other types of articles and/or tools.

In use of the abrasive cutting tool 110', each grain or particle of exposed abrasive particles on the abrasive cutting tool 110' surface cuts a small chip from a workpiece via shear deformation. As the abrasive cutting tool 110' is used, exposed abrasive particles can become dull or dislodged, causing the tool to lose its effectiveness. "Dressing" the abrasive cutting tool 110' can "true" the tool and expose fresh abrasive material, thus effectively sharpening the tool. The abrasive material 111 and matrix 112 can be supported about a center core or substrate 113, which can be coupled to a spindle 114 for coupling the grinding wheel to a machine tool, such as a grinding machine or a grinder, although it should be recognized that an abrasive cutting tool need not include such a core or spindle. Typically, a spindle 114 will be constructed of a strong and non-brittle material sufficient to secure the abrasive cutting tool 110' to a machine tool.

Grinding is typically used to finish workpieces that require high surface quality (e.g., low surface roughness) and/or high accuracy of shape and dimension. Dimensional accuracy in grinding can be on the order of 0.000025 mm. Thus, grinding is often used in finishing operations to remove comparatively little material, typically about 0.25 to 0.50 mm depth. However, grinding is also used in roughing applications in which high volumes of material are rapidly removed.

In general, the abrasive material 111 can comprise any suitable material for an abrasive tool that will not interfere with an anodizing process, such as diamond, cubic boron nitride (CBN), corundum (aluminum oxide), silicon carbide, emery, pumice, sand, etc. However, abrasive and matrix types, as well as the dimensional and/or form tolerances of the abrasive cutting tool 110', can vary depending on the application. For example, the dimensional and/or form tolerances of the abrasive cutting tool 110' can be very tightly controlled when using the tool for finishing operations on optical components. In such cases, the abrasive cutting tool 110' must be within tolerance prior to its initial use, as well as when "dressed" after some use to prepare the tool for further use.

It has been found to be advantageous for certain applications to use abrasive cutting tools that utilize metal/diamond metal matrix composites made from diamond particles having thin layers of beta-SiC chemically bonded to the surfaces of the diamond particles. For example, an aluminum/diamond composite can be used as the matrix and abrasive. In this case, diamonds previously treated to form SiC surface layers serve as the abrasive material and an aluminum alloy serves as the matrix material. The SiC surface layers on the diamonds typically provide exceptionally strong bonds with the aluminum alloy. With a material such as this, meeting dimensional and/or form tolerances for the abrasive cutting tool using conventional methods can be difficult, if not impossible. For example, the matrix material, due to the exceptionally strong bonds with the SiC layers on the diamonds, can be difficult to machine. Thus, as described in more detail hereinafter, the matrix material can be anodized, and therefore chemically altered, to facilitate its removal. Thus, with regard to the present disclosure, the matrix comprises any material suitable for anodizing, such as aluminum, magnesium, titanium, niobium, tantalum, and/or zinc, or any other anodizable bonding or matrix material for an abrasive.

Accordingly, with further reference to FIG. 1, the system 100 can also comprise an anodizing station 120 to form an anodic layer on the anodizable bonding or matrix material. In some embodiments, the particles in the metal matrix composite can also comprise an anodizable material, such as aluminum. Thus, in such cases, the particles can also be anodized when anodizing the anodizable matrix material to form an anodic layer on the anodizable matrix material, such that the anodic layer includes anodized particles. Anodizing is an electrochemical process that can convert a suitable metal surface into an anodic oxide layer. With aluminum as an example, the anodic oxide structure originates from the aluminum substrate and is composed entirely of aluminum oxide. This aluminum oxide is not applied to the surface like paint or plating, but is fully integrated with the underlying aluminum substrate. Anodizing is accomplished by immersing the aluminum into an acid electrolyte bath and passing an electric current through the medium. A cathode is mounted to the inside of the anodizing tank. The aluminum acts as an anode, so that oxygen ions are released from the electrolyte to combine with the aluminum atoms at the surface of the part being anodized. Anodizing is therefore a matter of highly controlled oxidation, which can be utilized as disclosed herein to chemically alter the matrix material to facilitate its removal, such as by machining.

The system 100 can therefore further comprise a machining station 130 to machine at least a portion of the anodic layer. The machining station can include any suitable machine or tool for removing material from the article 110, such as a grinder, a mill, and/or a lathe. In one aspect, the system 100 can include an inspection station 140 to determine a size and/or a form of the article 110, such as to determine whether the article 110 is within a predetermined tolerance after machining, for example. Exposed particles may be ground or machined flat or "even" with the surrounding matrix material following a machining operation. This condition will prevent effective use of the abrasive cutting tool 110' of FIG. 2. Thus, the system 100 can also include a chemical and/or abrasive blasting material removal station 150 to remove the anodizable matrix material and/or the anodic layer material thereby removing or releasing abrasive material that was ground or machined flat and exposing new abrasive particle material from within the matrix material. The chemical and/or abrasive blasting material removal station 150 can include any suitable chemical or abrasive for etching, chemically stripping, or abrasive blasting the anodizable matrix material and/or the anodic layer material. For example, the abrasive cutting tool 110' of FIG. 2 can be etched in hydrofluoric acid to a desired depth in which a thin layer of anodizable matrix material can be removed. With the removal of this material, abrasive particles that were ground or machined during the machining process can be removed from the tool and new, intact abrasive particles can be revealed from the underlying material. In some cases, etching may not be effective to remove material from the anodic layer. In such cases, material from the anodic layer may be removed by abrasive blasting (e.g., with aluminum oxide) and/or chemical stripping (e.g., in a phosphoric-chromic acid solution). Accordingly, chemical stripping and/or abrasive blasting can be implemented to remove material from the anodic layer, including abrasive particles that were ground or machined during the machining process, and reveal new, intact abrasive particles from the underlying material. It should be recognized that abrasive blasting and/or chemical etching can also be utilized to remove anodizable matrix material.

The principles disclosed herein can enable precise machining of a metal matrix composite, particularly one that includes an anodizable matrix material such as aluminum. Some such composite materials can be very difficult to machine in a conventional manner. The techniques disclosed herein take advantage of the fact that an anodic layer formed by anodizing grows both above and below the initial surface of the anodizable material. Because the anodic oxide layer formed by anodizing is relatively brittle, the anodic oxide layer (including the particles in the metal matrix) can be machined precisely using conventional machining processes (e.g., milling, turning, grinding, etc). Thus, forming an anodic layer on a material that is difficult to machine can convert a surface layer of such a material into a material that is relatively easy to machine. Repeated anodizing and machining processes can be performed to gradually remove material until the article is acceptable or within tolerance.

FIGS. 3A-3E illustrate aspects of a method for forming an article made of a metal matrix composite material having particles bonded to an anodizable matrix material, which can include various aspects of the system 100 discussed above. In these figures, the particles have been omitted for clarity.

Figure 3A:
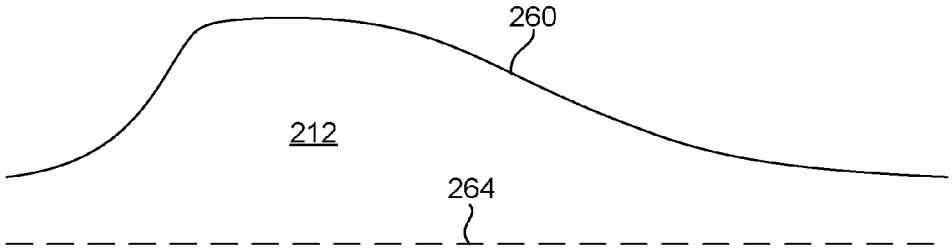
FIG. 3A is a detailed view of a matrix material surface of an article, in accordance with an example of the present disclosure.
Figure 3B:
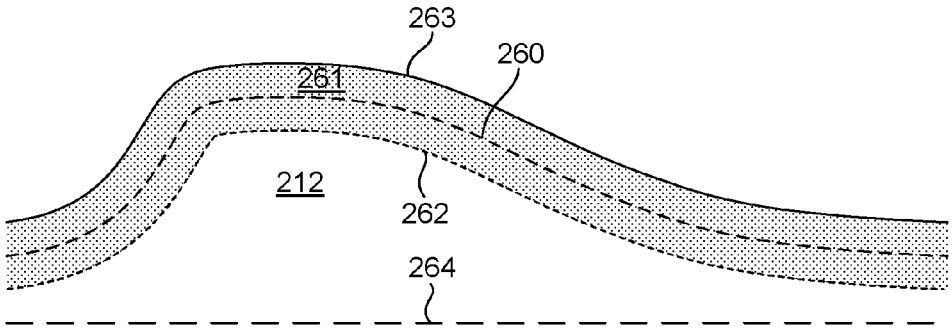
FIG. 3B is a detailed view of the matrix material surface of the article of FIG. 3A following an anodizing operation.

FIG. 3A illustrates a surface profile 260 of an anodizable bonding material 212 or matrix material of an article in accordance with an example of the present disclosure. For purposes of illustration, the surface profile 260 is "out of tolerance" From a required surface profile 264. Therefore, the anodizable matrix material 212 can be anodized or "hard anodized" to form an anodic layer 261 on the anodizable matrix material 212, as shown in FIG. 3B. The anodic layer 261 extends into the article from the original outer surface 260 of the anodizable matrix material 212 as represented by a boundary 262, and is built up external to the original outer surface 260 of the anodizable matrix material 212 to form a new outer surface 263. In one aspect, about half of the thickness of the anodic layer 261 can be located internal to the initial surface 260 of the anodizable material 212 and about half of the thickness of the anodic layer 261 can be located external to the initial surface 260 of the anodizable material 212.

Figure 3C:
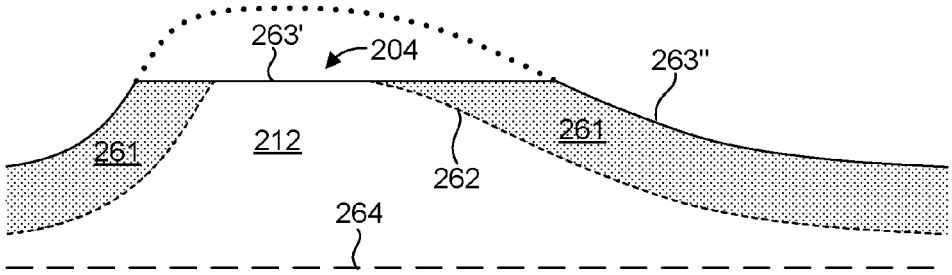
FIG. 3C is a detailed view of the matrix material surface of the article of FIG. 3A following a machining operation.

Following anodizing, at least a portion of the anodic layer 261 can be machined, such as by grinding, milling, and/or turning, as illustrated in FIG. 3C where reference number 263' indicates the machined surface, which may include a machined surface of the anodic layer as well as a machined surface of the anodizable matrix material. Reference number 263" indicates a surface of the anodic layer that was not machined. In some cases, such as when the article comprises an aluminum/diamond composite, machining can become difficult when the anodizable matrix material is encountered. In such cases, machining may effectively stop when the anodizable matrix material is exposed, as illustrated by reference number 204. Although the anodic layer can contain diamonds, this layer can be effectively ground with a diamond grinding wheel. Even a diamond wheel may become inefficient, however, as it reaches a bare aluminum/diamond composite surface.

Once the machining process has been completed, the article can be inspected to determine whether the surface 263', 263" of the article is within a predetermined tolerance. If not, then the process of anodizing and machining, as discussed above, can be repeated as many times as necessary to achieve the required geometry, such as until the outer surface of the article is within a required dimension and/or a form tolerance as represented by reference no. 264. When the shape of the article is acceptable and only a certain dimension is to be achieved, machining can follow the surface profile to remove the anodic layer. After removal of the anodic layer, anodizing and machining can be repeated as many times as needed to achieve the required dimension. To optimize the anodizing and machining sequence, the profile of the article can be measured after machining and the thickness of the anodic layer can be adjusted in the anodizing process and formed accordingly.

Figure 3D:
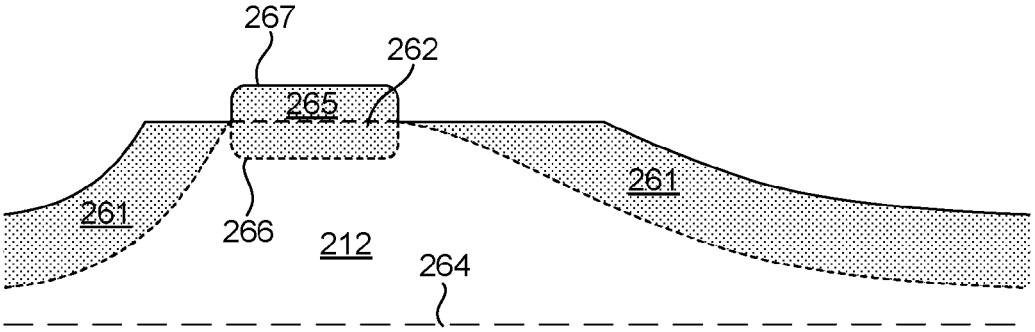
FIG. 3D is a detailed view of the matrix material surface of the article of FIG. 3A following another anodizing operation.
Figure 3E:
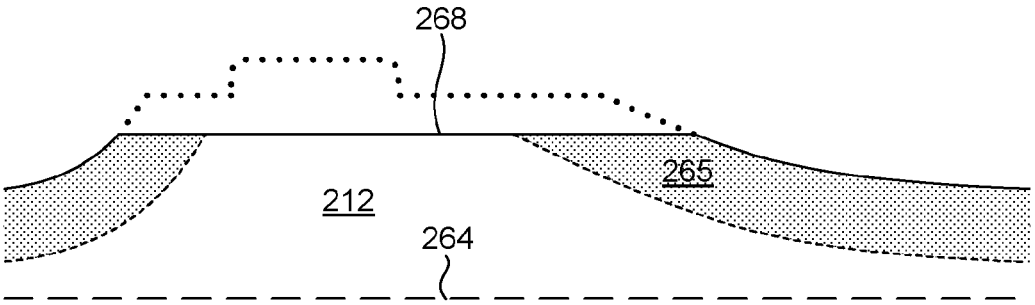
FIG. 3E is a detailed view of the matrix material surface of the article of FIG. 3A following another machining operation.

When the shape of the article is not within a required tolerance, then anodizing and machining processes can be applied as illustrated in FIGS. 3D and 3E. With the partially machined article of FIG. 3C, the newly exposed area 204 of the anodizable material 212 can be subjected to another anodizing, the result of which is illustrated in FIG. 3D. In this case, a new anodic layer 265 can be formed on the exposed area of the anodizable material. The anodic layer 261 remaining from the previous anodizing process may function as a mask, thus shielding the underlying anodizable material from further anodizing outside the exposed area of the anodizable material. In other words, the anodic layer formed in a subsequent anodizing process may grow only in an area where bare anodizable material is exposed, while anodized areas may remain mostly intact. The anodic layer 265 extends into the article from the previous boundary 262 of the anodizable matrix material as represented by a new boundary 266, and is built up external to the previous outer surface 263', 263" to form a new outer surface 267. After anodizing, the anodic layer 261, 265 can be machined, as illustrated in FIG. 3E, at least until the anodizable matrix material 212 is exposed. If machining a material that is difficult to machine, such as aluminum/diamond composite, encountering the non-anodized composite material may effectively stop further machining progress. The anodizing and machining sequence can be repeated as many times as needed until the required shape is achieved by the outer surface (i.e., newly machined surface 268), which can be determined by inspecting the article. After reaching the required shape or dimension, any remaining anodic layer material can be removed by chemical stripping and/or abrasive blasting, if desired. For example, the removal of such material may be needed due to the function of the article. In one aspect, the processes discussed with respect to FIGS. 3A-3E can be performed to achieve final or finish machining of an article made from a metal matrix composite.

Figure 4A:
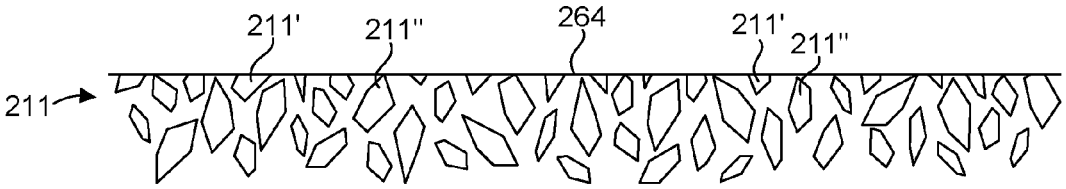
FIG. 4A is a detailed view of the article of FIG. 3A illustrating the matrix material surface and particles following the machining operation of FIG. 3E.
Figure 4B:
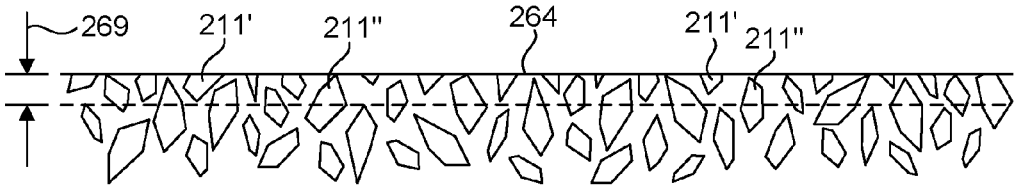
FIG. 4B illustrates matrix material removed by a controlled etching, abrasive blasting, and/or chemical stripping operation on the matrix material surface of FIG. 4A.
Figure 4C:
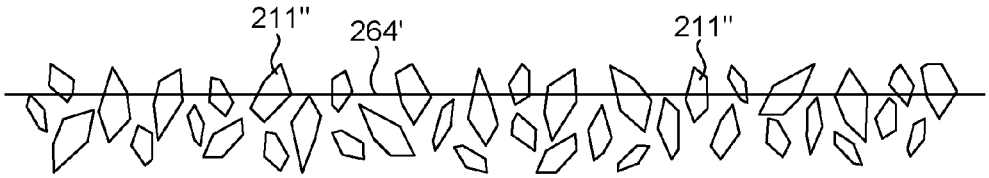
FIG. 4C illustrates the new matrix material surface and exposed abrasive particle material following the etching, abrasive blasting, and/or chemical stripping operation of FIG. 4B.

FIGS. 4A-4C illustrate additional aspects of a method for forming an article made of a metal matrix composite material having particles bonded to an anodizable matrix material, which can also include various aspects of the system 100 discussed above.

FIG. 4A illustrates the surface profile 264 of the article shown in FIGS. 3A-3E, which represents the required outer surface profile after all machining operations have been completed, such as when the outer surface profile has been deemed to be "in tolerance." Accordingly, the surface profile 264 can be defined by a machined surface (i.e., a machined portion of an anodizable matrix material and/or an anodic layer) and/or a surface that has not been machined (i.e., a natural outer surface of an anodic layer). FIG. 4A also illustrates particles 211, which includes machined or "flattened" particles 211' and intact particles 211".

When it is desirable to have particles exposed, such as for an abrasive cutting tool, as illustrated in FIG. 4B, the outer surface 264 can be etched, abrasive blasted, and/or chemically stripped to remove a predetermined material thickness 269. This can form a new surface 264' of the anodizable matrix material and/or an anodic layer, as illustrated in FIG. 4C. Controlled etching, abrasive blasting, and/or chemical stripping can therefore serve to remove the machined or flattened abrasive particles 211' from the tool and/or to expose underlying intact abrasive particles 211" with sharp cutting edges. Remaining anodizable matrix material and/or anodic layer material can have an etched, abrasive blasted, and/or a chemically etched outer surface. An etching, abrasive blasting, and/or chemical stripping process can be repeated as often as necessary to achieve a desired result. In one aspect, the abrasive cutting tool can be rotated and/or subjected to ultrasound during such processes to remove a uniform material thickness.

It should be recognized that the methods described herein can be used to form complex shapes on a surface of an article, such as an abrasive cutting tool or a heat dissipating structure. It should also be recognized that the methods described herein can also be used to dress an abrasive cutting tool to recondition the tool for further use. For example, in one aspect, the abrasive cutting tool can be machined and etched, abrasive blasted, and/or chemically stripped, as discussed above, to effectively dress the tool. In another aspect, the abrasive cutting tool can be etched, abrasive blasted, and/or chemically stripped, without machining, to simply remove worn abrasive particles and to reveal new, intact particles with sharp edges to effectively dress the tool. It is also noted that no specific order is required in the methods disclosed herein, though generally in some embodiments, method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method of forming an article made of a metal matrix composite material having particles bonded to an anodizable matrix material, comprising:

anodizing the anodizable matrix material to form an anodic layer on the anodizable matrix material;

machining at least a portion of the anodic layer;

removing at least a portion of the anodic layer after machining to expose at least a portion of the particles that are intact and bonded to the anodizable matrix material;

inspecting the article to determine whether the article is within a predetermined tolerance; and repeating at least the anodizing, machining, and inspecting steps until the article is within the predetermined tolerance.

2. The method of claim 1, wherein machining comprises grinding, milling, turning, or combinations thereof.

3. The method of claim 1, wherein the anodic layer is machined to at least one of a predetermined dimension and form tolerance.

4. The method of claim 1, wherein the anodic layer includes a portion of the particles.

5. The method of claim 1, wherein the article comprises a heat dissipating substrate.

6. The method of claim 1, wherein the particles comprise diamond particles with beta-SiC chemically bonded thereto.

7. The method of claim 6, wherein the anodizable matrix material comprises aluminum, magnesium, titanium, niobium, tantalum, zinc, or combinations thereof.

8. The method of claim 1, further comprising removing at least one of the anodizable matrix material or the anodic layer material by at least one of etching, abrasive blasting, or chemically stripping to remove a predetermined material thickness.

9. The method of claim 1, wherein the particles comprise an anodizable material, and wherein anodizing the anodizable matrix material to form an anodic layer on the anodizable matrix material further comprises anodizing the particles, such that the anodic layer includes anodized particles.

10. The method of claim 1, further comprising removing at least one of the anodizable matrix material or the anodic layer material.

* * * * *